US011782355B2

(12) United States Patent
Kawabata et al.

(10) Patent No.: US 11,782,355 B2
(45) Date of Patent: Oct. 10, 2023

(54) CHARGING MEMBER, CHARGING DEVICE, IMAGE FORMING APPARATUS, AND PROCESS CARTRIDGE

(71) Applicant: FUJIFILM Business Innovation Corp., Tokyo (JP)

(72) Inventors: Yukimi Kawabata, Kanagawa (JP); Fuyuki Kano, Kanagawa (JP); Kenta Yamakoshi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/903,102

(22) Filed: Sep. 6, 2022

(65) Prior Publication Data

US 2023/0229097 A1 Jul. 20, 2023

(30) Foreign Application Priority Data

Jan. 17, 2022 (JP) ..... 2022-005221

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS

| | | | | |
|---|---|---|---|---|
| 11,644,762 | B2 * | 5/2023 | Kinuta | G03G 15/0233 399/111 |
| 2014/0219682 | A1 * | 8/2014 | Tsu | G03G 15/0233 399/176 |
| 2017/0003616 | A1 * | 1/2017 | Kamijo | G03G 15/0233 |
| 2022/0244658 | A1 * | 8/2022 | Yamada | G03G 15/0233 |
| 2022/0244673 | A1 * | 8/2022 | Takashima | C08G 18/48 |
| 2023/0068161 | A1 * | 3/2023 | Kinuta | G03G 5/047 |

FOREIGN PATENT DOCUMENTS

| | | | |
|---|---|---|---|
| JP | 2016118647 | A * | 6/2016 |
| JP | 2017062435 | A * | 3/2017 |
| JP | 6164131 | B2 * | 7/2017 |
| JP | 6291953 | B2 | 3/2018 |

* cited by examiner

*Primary Examiner* — Ryan D Walsh
(74) *Attorney, Agent, or Firm* — Sughrue Mion, PLLC

(57) ABSTRACT

A charging member of a contact charging system that applies only a direct-current voltage to the charging member includes a conductive substrate, an elastic layer disposed on the conductive substrate, and a surface layer disposed on the elastic layer. When measured by an alternating-current impedance method within a range of 1 MHz to 1 mHz in an environment at a temperature of 28° C. and a humidity of 85%, a resistance component R of an impedance within a range of 1 Hz to 100 Hz is $4.0\times10^4$ Ω or more and $1.0\times10^6$ Ω or less and an impedance Z within a range of 1 Hz to 100 Hz is over $3.6\times10^4$ Ω and $3.5\times10^5$ Ω or less.

13 Claims, 4 Drawing Sheets

CHARGING MEMBER, CHARGING DEVICE, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2022-005221filed Jan. 17, 2022.

BACKGROUND (i) Technical Field

The present disclosure relates to a charging member, a charging device, an image forming apparatus, and a process cartridge.

(ii) Related Art

In recent years, electrophotographic image formation has been widely used for image forming apparatuses such as a copying machine, a laser printer, and the like.

In an image forming apparatus using an electrophotographic system, first the surface of an electrophotographic photoreceptor is charged by a charging device, and an electrostatic latent image is formed by a laser beam or the like modified based on image signals. Then, the electrostatic latent image on the surface of the electrophotographic photoreceptor is visualized by development with a charged toner, forming a toner image. The toner image is electrostatically transferred to a recording material, such as recording paper or the like, through an intermediate transfer body or directly, and then fixed to the recording material, thereby forming a reproduced image.

For example, Japanese Patent No. 6291953 discloses a charging member including a conductive support member, a conductive elastic layer disposed on the conductive support member, and a surface layer disposed on the conductive elastic layer. When measured within a range of 1 MHz to 1 mHz by an alternating-current impedance method, a high-frequency resistance component at 100 Hz or more and less than 10 kHz is $1.20\times10^4$ Ω or more and $2.99\times10^4$ Ω or less, and a low-frequency resistance component at 0.1 Hz or more and 10 Hz or less is $2.48\times10^4$ Ω or more and $3.60\times10^4$ Ω or less.

SUMMARY

Aspects of non-limiting embodiments of the present disclosure relate to a charging member excellent in the color streak occurrence-suppressing property in the resultant image as compared with a case where in a contact charging system that applies only a direct-current voltage (may be referred to as a "DC contact charging system" hereinafter), when measured by an alternating-current impedance method within a range of 1 MHz to 1 mHz in an environment at a temperature of 28° C. and a humidity of 85%, a resistance component R of an impedance within a range of 1 Hz to 100 Hz is less than $4.0\times10^4$ Ω or over $1.0\times10^6$ Ω or an impedance Z within a range of 1 Hz to 100 Hz is $3.6\times10^4$ Ω or less or over $3.5\times10^5$ Ω.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a charging member of a contact charging system that applies only a direct-current voltage to the charging member, the charging member including a conductive substrate, an elastic layer disposed on the conductive substrate, and a surface layer disposed on the elastic layer, wherein when measured by an alternating-current impedance method within a range of 1 MHz to 1 mHz in an environment at a temperature of 28° C. and a humidity of 85%, a resistance component R of an impedance within a range of 1 Hz to 100 Hz is $4.0\times10^4$ Ω or more and $1.0\times10^6$ Ω or less and an impedance Z within a range of 1 Hz to 100 Hz is over $3.6\times10^4$ Ω and $3.5\times10^5$ Ω or less.

BRIEF DESCRIPTION OF THE DRAWINGS

Exemplary embodiments of the present disclosure will be described in detail based on the following figures, wherein.

DETAILED DESCRIPTION

Figure 1:
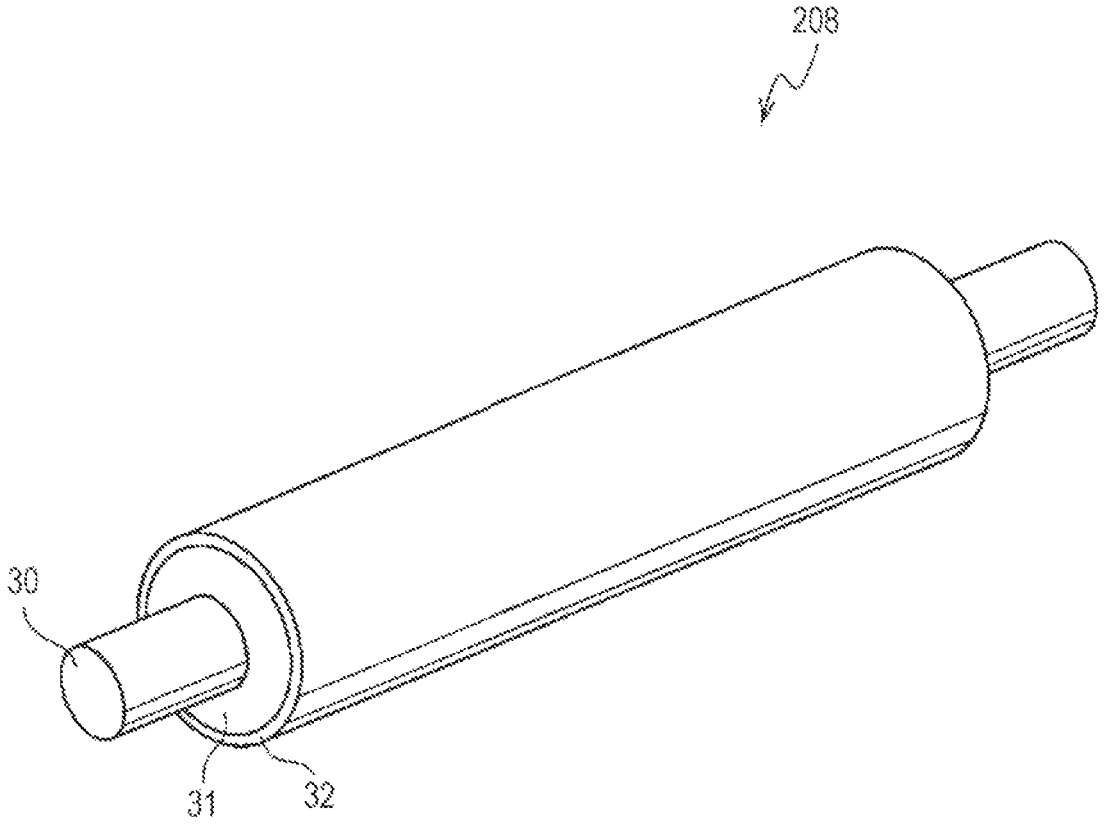
FIG. 1 is a schematic view showing an example of a configuration of a charging member according to an exemplary embodiment of the present disclosure.

An exemplary embodiment of the present disclosure is described below.

The upper limit value or lower limit value described in one of the numerical ranges stepwisely described may be substituted by the upper limit value or lower limit value of another of the numerical ranges stepwisely described.

In addition, the upper limit value or lower limit value described in a numerical range of the numerical ranges may be substituted by the value described in an example.

When there are plural materials corresponding to each of the components in a composition, the amount of each of the components in the composition represents a total amount of the materials present in the composition unless otherwise specified.

The term "process" includes not only an independent process but also even a process which cannot be distinguished from another process as long as the expected object of the process is achieved.

[Charging Member]

A charging member according to an exemplary embodiment of the present disclosure is a charging member of a contact charging system that applies only a direct-current voltage, the charging member including a conductive substrate, an elastic layer disposed on the conductive substrate, and a surface layer disposed on the elastic layer. When measured by an alternating-current impedance method within a range of 1 MHz to 1 mHz in an environment at a temperature of 28° C. and a humidity of 85%, a resistance component R of an impedance within a range of 1 Hz to 100 Hz is $4.0\times10^4$ Ω or more and $1.0\times10^6$ Ω or less and an impedance Z within a range of 1 Hz to 100 Hz is over $3.6\times10^4$ Ω and $3.5\times10^5$ Ω or less.

The charging member according to the exemplary embodiment has the resistance component R of $4.0\times10^4$ Ω or more and $1.0\times10^6$ Ω or less, and thus an average voltage drop and local voltage drop by the charging member with the applied voltage are suppressed, thereby suppressing variation in discharge immediately in front of a contact portion between an electrophotographic photoreceptor and the charging member. Also, the impedance Z is over $3.6\times10^4$ Ω and $3.5\times10^5$ Ω or less, and thus excellent followability to charge transfer is exhibited in the discharge time at the time of passage through the contact portion between the electrophotographic photoreceptor and the charging member. Thus, discharge omission immediately behind the contact portion between the electrophotographic photoreceptor and the charging member is suppressed, thereby suppressing both the occurrence of color streaks due to the discharge variation and the occurrence of color streaks due to the discharge omission.

Examples of the shape of the charging member according to the exemplary embodiment include, but are not particularly limited to, a roll shape, a brush shape, a belt (tube) shape, a blade shape, and the like. Among these, a roll-shaped charging member described in the exemplary embodiment is preferred, that is, a so-called charging member shape is preferred. The roll-shaped charging member (may be referred to as the "charging member" hereinafter) is largely described as an example of the charging member according to the exemplary embodiment.

In the present specification, the term "conductive" represents that the volume resistivity at 20° C. is less than 1×10 Ωcm, and the "semiconductive" represents that the volume resistivity at 20° C. is 1×10 Ωcm or more and $1\times10^{10}$ Ωcm or less. In addition, in the present specification, the volume resistivity is a value measured by volume resistance meter MODEL 152-1 manufactured by TREK Inc. or the like.

FIG. 1 shows an example of the configuration of the charging member according to the exemplary embodiment. The charging member shown in FIG. 1 is a charging member 208 including a cylindrical or columnar rod-like member (shaft) 30 serving as a conductive substrate, an elastic layer 31 disposed on the outer peripheral surface of the shaft 30, and a surface layer 32 disposed on the outer peripheral surface of the elastic layer 31. The shaft 30 and the elastic layer 31 are bonded to each other with an adhesive layer (not shown in the drawing).

(Resistance Component R of Impedance)

In the charging member according to the exemplary embodiment, when measured by an alternating-current impedance method within a range of 1 MHz to 1 mHz in an environment at a temperature of 28° C. and a humidity of 85%, the resistance component R of an impedance within a range of 1 Hz to 100 Hz is $4.0\times10^4$ Ω or more and $1.0\times10^6$ Ω or less, and from the viewpoint of the color streak occurrence-suppressing property, R is preferably $4.0\times10^4$ Ω or more and $7.5\times10^5$ Ω or less and more preferably $4.0\times10^4$ Ω or more and $2.0\times10^5$ Ω or less.

(Impedance)

In the charging member according to the exemplary embodiment, when measured by an alternating-current impedance method within a range of 1 MHz to 1 mHz in an environment at a temperature of 28° C. and a humidity of 85%, the impedance Z within a range of 1 Hz to 100 Hz is over $3.6\times10^4$ Ω and $3.5\times10^5$ Ω or less, and from the viewpoint of the color streak occurrence-suppressing property, Z is preferably over $3.6\times10^4$ Ω and $3.0\times10^5$ Ω or less and more preferably over $3.6\times10^4$ Ω and $2.7\times10^5$ Ω or less.

In the exemplary embodiment, the impedance Z and the resistance component R of the impedance (real number component of the impedance Z) are measured by a method described below.

The impedance Z and the resistance component R of the impedance are measured by using, as a power source and an ammeter, SI 1260 Impedance/gain phase analyzer (manufactured by Toyo Corporation) and, as a current amplifier, 1296 dielectric interface (manufactured by Toyo Corporation).

In a sample (charging member) for measuring the impedance, a conductive substrate is used as a cathode, and an aluminum plate having a width of 1.5 cm wound one turn around the surface of the charging member is used as an anode. The impedance Z and the resistance component R of the impedance of the sample are measured by an alternating-current impedance method in which an alternating-current voltage of 1 Vp-p is applied from a high-frequency side within a frequency range of 1 MHz to 1 mHz.

The resistance of the charging member according to the exemplary embodiment is adjusted largely by the type and content of a conductive agent contained in the elastic layer and the surface layer, and the type and composition ratio of a solvent, the solid content, and the type and amount of a resin in a coating solution when the surface layer is formed by coating.

(Surface Roughness Rz)

From the viewpoint of the color streak occurrence-suppressing property, the charging member according to the exemplary embodiment preferably has a surface roughness Rz of 2 μm or more and 6 μm or less, more preferably 3 μm or more and 5 μm or less, and particularly preferably 3.5 μm or more and 4.5 μm or less. With the surface roughness Rz within the range described above, the contaminating component contained in a developer or the like adhered to the surface of the charging member is hardly transferred to the charging member, and the contaminating component is easily removed by a cleaning member or the like for the charging member. Therefore, the influence of the contaminating component is suppressed, and discharge omission immediately behind the contact portion between the electrophotographic photoreceptor and the charging member is more suppressed, thereby more improving the color streak occurrence-suppressing property.

The surface roughness Rz (10-point average roughness Rz) in the exemplary embodiment is surface roughness measured according to JIS B 0601: 1994. The surface roughness Rz is measured in an environment at a temperature of 23° C. and relative humidity of 55% by using a contact-type surface roughness tester (Surfcom 570A, manufactured by Tokyo Seimitsu Co., Ltd.) and a stylus having a diamond tip (5 μm R, 90° cone). The measurement distance is 2.5 mm, and a measurement part ranges from a position of 5 mm to a position of 7.5 mm from an end of a discharge region. When the shape of the charging member is a roll shape, a belt shape, or a tube shape, the measurement is performed at 4 positions at intervals of 90 degrees in the circumferential direction of the charging member at both ends of the discharge region, and an average of the vales at a total of 8 positions is calculated. When the shape of the charging member is a blade shape, measurement is performed at both ends of the discharge region at a center in the width direction (direction perpendicular to the axial direction) of the blade, and an average of the values at a total of 2 positions is calculated.

(Surface Layer)

The surface layer 32 is a layer formed largely for preventing contamination with a toner or the like, and is formed by dispersing particles in a binder resin.

Examples of the binder resin used for the surface layer 32 include a urethane resin, polyester, a phenol resin, an acrylic resin, an epoxy resin, cellulose, and the like.

Among these, from the viewpoint of the color streak occurrence-suppressing property, the binder resin preferably contains a polyvinyl butyral resin and more preferably contains a polyamide resin and a polyvinyl butyral resin, and the surface layer particularly preferably has a sea-island structure having a sea structure made of the polyamide resin, and an island structure made of the polyvinyl butyral resin.

In addition, from the viewpoint of adjusting the impedance Z and the resistance component R of the impedance and the color streak occurrence-suppressing property, the content ratio of the polyamide resin to the polyvinyl butyral resin in the surface layer is preferably polyamide resin : polyvinyl butyral resin=5:5 to 9.5:0.5, more preferably 6:4 to 9:1, and particularly preferably 6.5:3.5 to 8.5:1.5.

The particles contained in the surface layer 32 are used for the purpose of decreasing an environmental change of the resistance value of the surface layer 32 by controlling the resistance using a conductive material and thus obtaining stable charging characteristics, and of decreasing the frictional coefficient to the photoreceptor by controlling the irregularity of the roll surface and thus improving the abrasion resistance between photoreceptors. Also, an additive can be used for the purpose of improving the adhesion to a lower layer (for example, the elastic layer 31) and controlling the dispersion of the particles in the binder resin.

The conductive particles preferably have a particle diameter of 3 μm or less and a volume resistivity of $10^9$ Ωcm or less. Usable examples thereof include particles composed of metal oxides or alloys thereof, such as tin oxide, titanium oxide, zinc oxide, and the like, carbon black, and the like.

In particular, the conductive particles contained in the surface layer 32 influence the resistance (the impedance Z and the resistance component R of the impedance) of the charging member, and the type and content of the particles may be selected according to the intended resistance. The conductive particles are preferably mixed within a range of 2 parts by mass or more and 20 parts by mass or less relative to 100 parts by mass of the binder resin contained in the surface layer 32.

In particular, the surface layer preferably contains carbon black as the conductive particles from the viewpoint of adjusting the impedance Z the resistance component R of the impedance and the color streak occurrence-suppressing property.

From the viewpoint of adjusting the impedance Z the resistance component R of the impedance and the color streak occurrence-suppressing property, the content of carbon black relative to the total mass of the surface layer is preferably 5% by mass or more and 20% by mass or less, more preferably 6% by mass or more and 15% by mass or less, and particularly preferably 8% by mass or more and 13% by mass or less.

In addition, fluorine-based or silicone-based, alumina or silica, or polyamide-based particles can be used other particles, and the particle diameter thereof is preferably 3 μm or more and 10 μm or less.

In particular, the surface layer preferably contains polyamide-based particles as the other particles from the viewpoint of the color streak occurrence-suppressing property.

From the viewpoint of adjusting the impedance Z and the resistance component R of the impedance and the color streak occurrence-suppressing property, the content of the polyamide-based particles relative to the total mass of the surface layer is preferably 2% by mass or more and 15% by mass or less, more preferably 3% by mass or more and 10% by mass or less, and particularly preferably 5% by mass or more and 8% by mass or less, The surface layer according to the exemplary embodiment preferably contains carbon black particles and polyamide particles, and dimethylsiloxane as an additive, for suppressing the occurrence of color streaks.

The surface layer 32 is formed by coating, on the elastic layer, a coating solution (coating solution for forming a surface layer) containing the binder resin and the particles, and an additive added if required.

Usable examples of a coating method for the coating solution for forming a surface layer include usual methods such as a roll coating method, a blade coating method, a wire bar coating method, a spray coating method, a dip coating method, a bead coating method, an air knife coating method, a curtain coating method, and the like.

The surface layer is formed by drying after coating the coating solution for forming a surface layer. The drying temperature is, for example, 80° C. or more and 200° C. or less.

The thickness of the surface layer 32 is preferably about 5 μm or more and 20 μm or less and more preferably about 7 μm or more and 13 μm or less.

Also, the volume resistivity of the surface layer is preferably $1\times10^3$ Ωcm or more and $1\times10^{14}$ Ωcm or less.

<Method for Forming Surface Layer>

A method for forming the surface layer is not particularly limited, and a known forming method is used. For example, a coating film is formed by using the coating solution for forming a surface layer, prepared by adding a solvent to the components described above, and the coating film is dried and, if required, heated.

Examples of the solvent for preparing the coating solution for forming a surface layer include known organic solvents such as an alcohol-based solvent, an aromatic hydrocarbon solvent, a halogenated hydrocarbon solvent, a ketone-based solvent, a ketone alcohol-based solvent, an ether-based solvent, an ester-based solvent, and the like.

Specific examples of the solvents include usual organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, toluene, and the like. A solvent (for example, alcohol or the like) having at least one or more hydroxyl groups or an ether solvent (for example, tetrahydrofuran) is preferably used as the solvent.

From the viewpoint of adjusting the impedance Z and the resistance component R of the impedance and the color streak occurrence-suppressing property, two types of alcohols are preferably contained, two types selected from the group including methanol, ethanol, and n-propanol are more preferably contained, and methanol and n-propanol are particularly preferably contained.

In addition, from the viewpoint of adjusting the impedance Z and the resistance component R of the impedance and the color streak occurrence-suppressing property, the mixing ratio of methanol to n-propanol in terms of mass ratio is preferably methanol : n-propanol=1:1 to 20:1, more preferably 6:4 to 10:1, and particular preferably 7:3 to 9:1.

From the viewpoint of adjusting the impedance Z and the resistance component R of the impedance and the color streak occurrence-suppressing property, the solid content amount in the coating solution for forming a surface layer is preferably 10% by mass to 30% by mass, more preferably 16% by mass to 25% by mass, and particularly preferably 17% by mass to 23% by mass.

Examples of a method for dispersing the particles or the like for preparing the coating solution for forming a surface layer include known methods such as a roll mill, a ball mill, a vibrating ball mill, an attritor, a sand mill, a colloid mill, a paint shaker, and the like.

The particles are hardly dissolved in an organic solvent and are thus preferably dispersed in the organic solvent. Examples of a dispersing method include known methods such as a roll mill, a ball mill, a vibrating ball mill, an attritor, a sand mill, a colloid mill, a paint shaker, and the like.

Examples of a method for coating the coating solution for forming a surface layer include usual methods such as a blade coating method, a wire bar coating method, a spray coating method, a dip coating method, a bead coating method, an air knife coating method, a curtain coating method, and the like.

(Conductive Substrate)

The charging member according to the exemplary embodiment includes the conductive substrate.

The conducive substate according to the exemplary embodiment functions as an electrode and a support member of the charging member, and examples of the material thereof include conducive materials such as metals or alloys, such as iron (free cutting steel or the like), copper, brass, stainless, aluminum, nickel, and the like; iron plated with nickel or the like; conductive resin; and the like.

The conductive substrate is a conductive rod-like member, and examples thereof include a member (for example, a resin or ceramic member) having a plated outer peripheral surface, a member (for example, a resin or ceramic member) containing a conductive agent dispersed therein, and the like.

The conductive substrate may be a hollow member (cylindrical member) or a non-hollow member.

(Elastic Layer)

The charging member according to the exemplary embodiment includes the elastic layer disposed on the conductive substrate.

The elastic layer is preferably disposed in a roll shape on the outer peripheral surface of the conductive substrate (shaft).

The elastic layer is configured to contain, for example, an elastic material, a conductive agent, and, if required, other additives.

Examples of the elastic material include isoprene rubber, chloroprene rubber, epichlorohydrin rubber, butyl rubber, polyurethane, silicone rubber, fluorocarbon rubber, styrene-butadiene rubber, butadiene rubber, nitrile rubber, ethylene propylene rubber, epichlorohydrin-ethylene oxide copolymer, epichlorohydrin-ethylene oxide-allyl glycidyl ether copolymer rubber, ethylene-propylene-diene terpolymer rubber (EPDM), acrylonitrile-butadiene copolymer rubber (NBR), natural rubber, and the like; and blend rubber thereof. Among these, polyurethane, silicone rubber, EPDM, epichlorohydrin-ethylene oxide copolymer rubber, epichlorohydrin-ethylene oxide-allyl glycidyl ether copolymer rubber, NBR, and blend rubber thereof are preferably used. These elastic materials may be foamed or unfoamed materials.

The conductive agent is, for example, an electronic conductive agent or an ionic conductive agent.

Examples of the electronic conductive agent include powders of carbon black such as ketjen black, acetylene black, and the like; pyrolytic carbon and graphite; conductive metals or alloys such as aluminum, copper, nickel, stainless steel, and the like; various conductive metal oxides such as tin oxide, indium oxide, titanium oxide, tin oxide-antimony oxide solid solution, tin oxide-indium oxide solid solution, and the like; insulating materials with conductively treated surfaces: and the like.

Examples of the ionic conductive agent include perchlorates, chlorates, and the like of tetraethylammonium, lauryltrimethylammonium, and the like; and perchlorates, chlorates, and the like of alkali metals and alkaline-earth metals such as lithium, magnesium, and the like.

The conductive agents may be used alone or in combination of two or more.

Specific examples of carbon black include "Special Black 350", "Special Black 100", "Special Black 250", "Special Black 5", "Special Black 4", "Special Black 4A", "Special Black 550", "Special Black 6", "Color Black FW200", "Color black FW2", and "Color black FW2V", which are manufactured by Degussa Corporation; and "MONARCH 1000", "MONARCH 1300", "MONARCH1 400", "MOGUL-L", and "REGAL 400R", which are manufactured by Cabot Corporation.

The average particle diameter of the conductive agent is preferably 1 nm or more and 200 nm or less. The average particle diameter is an average particle diameter obtained by observing the conductive agent with an electron microscope, measuring the diameters of 100 particles of the conductive agent, and averaging the measured values.

The amount of the conductive agent added in the elastic layer 31 is not particularly limited, but in the case of the electronic conductive agent, the amount relative to 100 parts by mass of the elastic material is preferably within a range of 1 part by mass or more and 30 parts by mass or less and more preferably within a range of 15 parts by mass or more and 25 parts by mass or less.

While in the case of the ionic conductive agent, the amount relative to 100 parts by mass of the elastic material is preferably within a range of 0.1 parts by mass or more and 5.0 parts by mass or less and more preferably within a range of 0.5 parts by mass or more and 3.0 parts by mass or less.

Examples of other additives mixed in the elastic layer 31 include materials which can be added to a known elastic layer, such as a softener, a plasticizer, a curing agent, a vulcanizing agent, a vulcanization accelerator, an antioxidant, a surfactant, a coupling agent, a filler (silica, calcium carbonate, or the like), and the like.

In forming the elastic layer 31, a mixing method and a mixing order for the components constituting the elastic layer 31, such as the conductive agent, the elastic material, and other components (components such as a vulcanizing agent, and a foaming agent added if required), are not particularly limited, but a general method is a method of previously mixing the components by using a tumbler, a V-blender, or the like, and melt-mixing and extrusion-molding the components by an extruder.

The thickness of the elastic layer is preferably about 1 mm or more and 10 mm or less and more preferably about 2 mm or more and 5 mm or less.

Also, the volume resistivity of the elastic layer is preferably $10^3$ Ωcm or more and $10^{14}$ Ωcm or less.

[Charging Device, Image Forming Apparatus, and Process Cartridge]

A charging device according to an exemplary embodiment of the present disclosure is a charging device including the charging member according to the exemplary embodiment, and is preferably a charging device including the charging member according to the exemplary embodiment and charging the surface of an electrophotographic photoreceptor by a contact charging system that applies only a direct-current voltage to the charging member.

An image forming apparatus according to an exemplary embodiment of the present disclosure includes an electrophotographic photoreceptor and the charging member according to the exemplary embodiment described above, and further includes a charging unit which charges the surface of the electrophotographic photoreceptor by a contact charging system that applies only a direct-current voltage to the charging member, an electrostatic latent image forming unit which forms an electrostatic latent image on the charged surface of the electrophotographic photoreceptor, a developing unit which develops the electrostatic latent image formed on the surface of the electrophotographic photoreceptor by a developer containing a toner to form a toner image, and a transfer unit which transfers the toner image to the surface of a recording medium.

The image forming apparatus according to the exemplary embodiment is applied to known image forming apparatuses, such an apparatus including a fixing unit which fixes a toner image transferred to the surface of a recording medium; an apparatus of a direct transfer system in which a toner image formed on the surface of an electrophotographic photoreceptor is transferred directly to a recording medium; an apparatus of an intermediate transfer system in which a toner image formed on the surface of an electrophotographic photoreceptor is first transferred to the surface of an intermediate transfer body, and the toner image transferred to the surface of the intermediate transfer body is second transferred to the surface of a recording medium; an apparatus including a cleaning unit which cleans the surface of an electrophotographic photoreceptor before charging after transfer of a toner image; an apparatus including an electrophotographic photoreceptor heating member which decreases the relative temperature of an electrophotographic photoreceptor by increasing the temperature thereof; and the like.

In the apparatus of an intermediate transfer system, a configuration applied to the transfer unit includes an intermediate transfer body to the surface of which a toner image is transferred, a first transfer unit which first transfers the toner image formed on the surface of an image holding member to the surface of the intermediate transfer body, and a second transfer unit which second transfers the toner image transferred to the surface of the intermediate transfer body to the surface of a recording medium.

The image forming apparatus according to the exemplary embodiment may be any one of an image forming apparatus of a dry development system, and an image forming apparatus of a wet development system (development system using a liquid developer).

In the image forming apparatus according to the exemplary embodiment, for example, a portion provided with the charging member according to the exemplary embodiment may be a cartridge structure (process cartridge) detachable from the image forming apparatus. For example, a process cartridge provided with the charging member according to the exemplary embodiment is preferably used as the process cartridge. The process cartridge may be provided with, besides the charging member according to the exemplary embodiment, for example, at least one selected from the group including an electrophotographic photoreceptor, an electrostatic latent image forming unit, a developing unit, and a transfer unit.

An example of the image forming apparatus according to the exemplary embodiment is described below, but the present disclosure is not limited to this. A principal portion shown in the drawings is described, and description of other portions is omitted.

<First Exemplary Embodiment>

Figure 2:
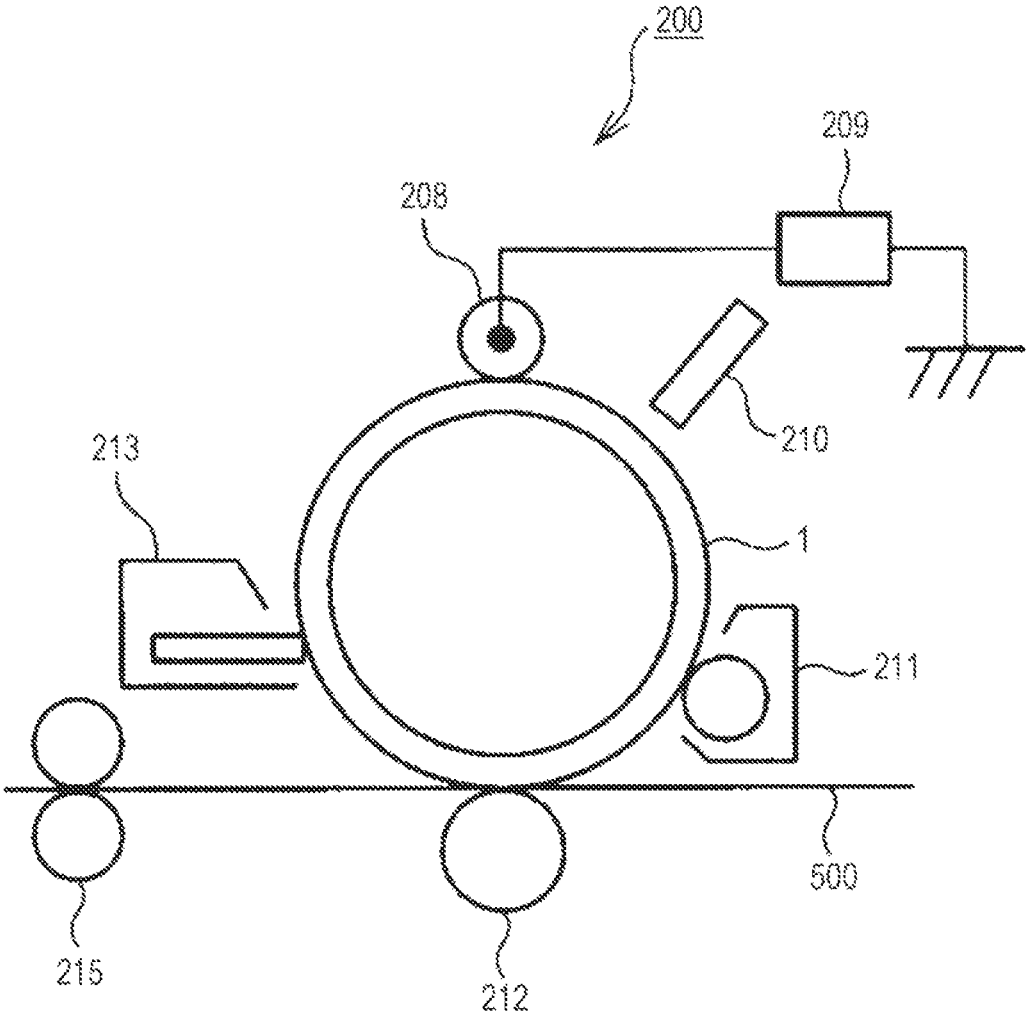
FIG. 2 is a schematic view showing an example of a basic configuration of an image forming apparatus according to an exemplary embodiment of the present disclosure.

FIG. 2 schematically shows the basic configuration of an image forming apparatus of a first exemplary embodiment. An image forming apparatus 200 shown in FIG. 2 includes an electrophotographic photoreceptor 1, a charging derive (charging unit) of a DC contact charging system which is connected to a power source 209 and charges the electrophotographic photoreceptor 1, an exposure device 210 (electrostatic latent image forming unit) which exposes the electrophotographic photoreceptor 1 charged by the charging device to form an electrostatic latent image, a developing device 211 (developing unit) which develops the electrostatic latent image formed by the exposure device 210 with a developer containing a toner to form a toner image, a transfer device 212 (transfer unit) which transfers the toner image formed on the surface of the electrophotographic photoreceptor 1 to a recording medium 500, a toner removing device 213 (toner removing unit) which removes the toner remaining on the surface of the electrophotographic photoreceptor 1 after transfer, and a fixing device 215 (fixing unit) which fixes the toner image transferred to the recording medium 500 to the recording medium 500.

The image forming apparatus 200 shown in FIG. 2 is an image forming apparatus of an erase-less system not provided with a static elimination unit which removes charge remaining on the surface of the photoreceptor after transfer of the toner image on the surface of the photoreceptor. In general, when a static elimination unit, which removes charge remaining on the surface of the photoreceptor, is not provided, color streaks easily occur in an image. However, the image forming apparatus according to the exemplary embodiment suppresses the occurrence of color streaks even when the static elimination unit is not provided.

(Electrophotographic Photoreceptor)

The electrophotographic photoreceptor 1 is not particularly limited, and a known electrophotographic photoreceptor can be used. An example thereof is a photoreceptor including a function-separated type photosensitive layer, in which an undercoating layer, a charge generation layer, and a charge transport layer are laminated in this order, and the charge generation layer and the charge transport layer are separately provided. Also, the photoreceptor may be a function integrated type including a photosensitive layer in which a charge generation layer and a charge transport layer are integrally formed.

Also, the photoreceptor 1 may not include the undercoating layer, may include an intermediate layer provided between the undercoating layer and the photosensitive layer, or may include a protective layer, containing a charge transport material, provided on the photosensitive later.

In the electrophotographic photoreceptor 1 according to the exemplary embodiment, from the viewpoint of suppressing the occurrence of color streaks and elongating the lifetime, the total thickness of the surface layer having charge transportability is preferably 24 μm or more and 50 μm or less and more preferably 28 μm or more and 38 μm or less.

For example, when a function-separated type photoreceptor including a charge transport layer as an outermost surface layer is used for an image forming apparatus provided with a charging unit of a DC contact charging system, the larger the thickness of the charge transport layer is, the more an attempt is made to elongate the lifetime, but the more easily the color streaks occur. Also, when a second charge transport layer with more suppressed abrasion than a first charge transport layer is provided as a protective layer on the first charge transport layer, the larger the total thickness of the first charge transport layer and the second charge transport layer (protective layer) is, the more an attempt is made to elongate the lifetime, but the more easily the color streaks occur.

Also, in the case of the function-integrated type photoreceptor, the larger the total thickness of the surface layer including the charge transport layer is, the more an attempt is made to elongate the lifetime, but the more easily the color streaks occur.

However, using the charging member according to the exemplary embodiment suppresses the occurrence of color streaks and allows an attempt to elongate the lifetime even when the total thickness of the surface layer having charge transportability in the photoreceptor is 24 μm or more and 50 μm or less. In the exemplary embodiment, when the protective layer containing a charge transport material is provided on the function-separated photosensitive layer, the total thickness of the surface layer having charge transportability in the photosensitive layer is the thickness of the charge transport layer and the protective layer, while when a protective layer containing a charge transport material is provided on the function-integrated photosensitive layer, the total thickness is the total thickness of the photosensitive layer and the protective layer.

(Charging device)

The charging device is preferably a DC contact charging system charging device which has a charging member 208 according to the exemplary embodiment and which charges the surface of the electrophotographic photoreceptor 1 by applying a direct-current voltage. The voltage applied is, for example, a direct-current voltage of plus or minus 50 V or more and 2000 V or less according to the required photoreceptor charging voltage.

In addition, the pressure of contact between the charging member 208 and the photoreceptor 1 is, for example, within a range of 250 mgf or more and 600 mgf or less.

When the charging member 208 is brought into contact with the surface of the photoreceptor 1, the charging member is rotated following the photoreceptor 1 even when the charging unit does not have a driving unit. However, the charging member 208 may be provided with a driving unit so as to be rotated at a circumferential speed different from the photoreceptor 1.

(Exposure device)

A known exposure unit is used as the exposure device 210. Specific examples used as the exposure device include optical-system devices using a light source for exposure, such as a semiconductor laser, LED (Light Emitting Diode), a liquid crystal shutter, and the like. The quantity of light for writing is, for example, within a range of 0.5 $mJ/m^2$ or more and 5.0 $mJ/m^2$ or less on the surface of the photoreceptor.

(Developing device)

Examples of the developing device 211 include a developing unit of a two-component development system which develops by bringing a development brush (developer holding member), to which a developer including a carrier and a toner is adhered, into contact with the electrophotographic photoreceptor 1, a developing unit of a contact-type one-component development system which develops a toner on an electrophotographic photoreceptor by adhering the toner to a conductive rubber elastic-body transport roller (developer holding member), and the like.

The toner is not particularly limited as long as it is a known toner. Specifically, for example, a toner containing at least a binder resin and, if required, containing a colorant, a release agent, and the like may be used.

Examples of a method for producing a toner include, but are not particularly limited to, toner producing methods such as a usual grinding method, a wet melt-spheroidizing method of forming in a dispersion medium, and known polymerization methods such as suspension polymerization, dispersion polymerization, emulsion polymerization, and the like.

When the developer is a two-component developer containing a toner and a carrier, examples of the carrier include, but are not particularly limited to, magnetic metals such as iron oxide, nickel, cobalt, and the like; a carrier (non-coated carrier) including only a core material of a magnetic oxide, such as ferrite, magnetite, or the like; a resin-coated carrier including a resin layer provided on the surface of the cure material; and the like. In the two-component developer, for example, the mixing ratio (mass ratio) of the toner to the carrier is toner : carrier=within a range of 1:100 to 30:100 and may be within a range of 3:100 to 20:100.

(Transfer device)

Examples of the transfer device 212 include, besides a roll-shaped contact-type charging member, a contact-type transfer charger using a belt, a film, a rubber blade, or the like, a scorotron transfer charger or corotron transfer charger using corona discharge, and the like.

(Toner removing device)

The toner removing device 213 is provided for removing the remaining toner adhered to the surface of the electrophotographic photoreceptor 1 after transfer, and thus the electrophotographic photoreceptor 1 with the cleaned surface is repeatedly subjected to the image forming process described above. The toner removing device 213 uses, besides a foreign material removing member (cleaning blade), for example, brush cleaning, roll cleaning, or the like, but among these, the cleaning blade is preferably used. Examples of the material of the cleaning blade include urethane rubber, neoprene rubber, silicone rubber, and the like.

For example, when the remaining toner is not a problem, for example, when the toner hardly remains on the surface of the photoreceptor 1, the toner removing device 213 need not be provided.

The basic image forming process of the image forming apparatus 200 is described.

First, the surface of the photoreceptor 1 is charged to a predetermined potential by the charging device. Next, the charged surface of the photoreceptor 1 is exposed by the exposure device 210 based on an image signal to form an electrostatic latent image.

Next, the developer is held on the developer holding member of the developing device 211, and the developer held is transported to the photoreceptor 1 and supplied to the electrostatic latent image at a position where the developer holding member is adjacent (or in contact with) the photoreceptor 1. Thus, the electrostatic latent image is visualized to form a toner image.

The developed toner image is transported to the position of the transfer device 212 and transferred directly to the recording medium 500 by the transfer device 212.

Next, the recording medium 500 to which the toner image has been transferred is transported to the fixing device 215 and the toner image is fixed to the recording medium 500 by the fixing device 215. The fixing temperature is, for example, 100° C. or more and 180° C. or less.

On the other hand, after the toner image is transferred to the recording medium 500, the toner particles remaining untransferred on the photoreceptor 1 are carried to a contact position with the toner removing device 213 and recovered by the toner removing device 213.

As described above, an image is formed by the image forming apparatus 200. When a next image is formed, a next image forming process is performed without removal of charge on the surface of the photoreceptor 1.

<Second exemplary embodiment>

Figure 3:
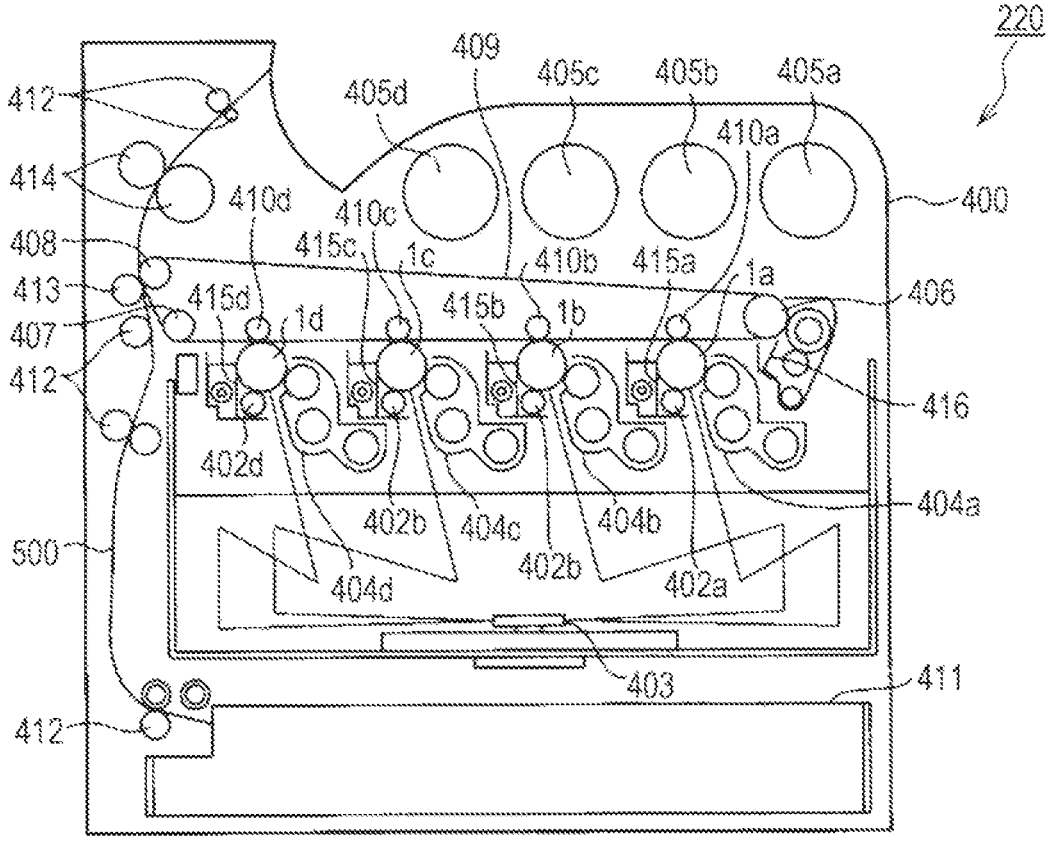
FIG. 3 is a schematic view showing another example of a basic configuration of an image forming apparatus according to an exemplary embodiment of the present disclosure.

FIG. 3 schematically shows the basic configuration of an image forming apparatus according to a second exemplary embodiment of the present disclosure. An image forming apparatus 220 shown in FIG. 3 is an intermediate transfer-system image forming apparatus in which four electrophotographic photoreceptors 1*a*, 1*b*, 1*c*, and 1*d* are arranged in parallel to each other along an intermediate transfer belt 409 in a housing 400. For example, the photoreceptor 1*a*, the photoreceptor 1*b*, the photoreceptor 1*c*, and the photoreceptor 1*d* form color images of yellow, magenta, cyan, and black, respectively.

Even the image forming apparatus 220 shown in FIG. 3 is an erase-less system image forming apparatus not provided with a static elimination unit which removes charge remaining on the surfaces of the photoreceptors after transfer of the toner image on the surface of each of the photoreceptors.

The electrophotographic photoreceptors 1*a*, 1*b*, 1*c*, and 1*d* are each rotated in a direction (the counterclockwise direction on the paper), and charging members 402*a*, 402*b*, 402*c*, and 402*d*, developing devices 404*a*, 404*b*, 404*c*, and 404*d*, first transfer rollers 410*a*, 410*b*, 410*c*, and 410*d*, and the cleaning blades 415*a*, 415*b*, 415*c*, and 415*d* are disposed along the respective rotation directions. Each of the charging members 402*a*, 402*b*, 402*c*, and 402*d* is the charging member according to the exemplary embodiment and uses a contact charging system that applies only a direct-current voltage.

The developing devices 404*a*, 404*b*, 404*c*, and 404*d* supply four color toners of yellow, magenta, cyan, and black housed in toner cartridges 405*a*, 405*b*, 405*c*, and 405*d*, respectively, and the first transfer rollers 410*a*, 410*b*, 410*c*, and 410*d* are in contact with the electrophotographic photoreceptors 1*a*, 1*b*, 1*c*, and 1*d*, respectively, through the intermediate transfer belt 409.

In addition, a laser light source (exposure device) 403 is disposed in the housing 400, and a laser beam emitted from the laser light source 403 is irradiated to the surfaces of the electrophotographic photoreceptors 1*a*, 1*b*, 1*c*, and 1*d* after charging.

Thus, charging, exposure, development, first transfer, and cleaning (removal of foreign materials such as the toner and the like) are sequentially performed in the rotation of each of the electrophotographic photoreceptors 1*a*, 1*b*, 1*c*, and 1*d*, and the toner images of the respective colors are transferred to be superposed on the intermediate transfer belt 409. After the toner images are transferred to the intermediate transfer belt 409, the electrophotographic photoreceptors 1*a*, 1*b*, 1*c*, and 1*d* are subjected to a next image forming process without through the removal of charge on the surfaces thereof.

The intermediate transfer belt 409 is supported with tension by a driving roller 406, a back roller 408, and a support roller 407 and is rotated by rotation of these rollers without causing deflection. In addition, a second transfer roller 413 is disposed to be in contact with the back roller 408 through the intermediate transfer belt 409. The intermediate transfer belt 409 passing through a position held between the back roller 408 and the second transfer roller 413 is surface-cleaned by, for example, the cleaning blade 416 disposed to face the driving roller 406 and then repeatedly subjected to a next image forming process.

In addition, a vessel 411 which houses a recording medium is provided in the housing 400, and the recording medium 500 such as paper in the vessel 411 is sequentially transported, by transport rollers 412, to a position held between the intermediate transfer belt 409 and the second transfer roller 413 and further to a position held two fixing rollers 414 in contact with each other, and then discharged to the outside of the housing 400.

In the above description, the case using the intermediate transfer belt 409 as the intermediate transfer body is described, but the intermediate transfer body may be a belt shape, such as the intermediate transfer belt 409, or a drum shape. In the case of the belt shape, a known resin is used as a resin material constituting the substrate of the intermediate transfer body. Examples thereof include resin materials such as a polyimide resin, a polycarbonate resin (PC), polyvinylidene fluoride (PVDF), polyalkylene terephthalate (PAT), blend materials such as ethylene-tetrafluoroethylene copolymer (ETFE)/PC, ETFE/PAT, and PC/PAT, polyester, polyether ether ketone, and polyamide, and resin materials using these materials as raw materials. Also, a blend of a resin material and an elastic material may be used.

The recording medium according to the exemplary embodiment is not particularly limited as long as it is a medium to which a toner image formed on an electrophotographic photoreceptor is transferred.

<Process cartridge>

The process cartridge according to the exemplary embodiment has a configuration detachable from an image forming apparatus and including a charging unit which has the charging member according to the exemplary embodiment and charges the surface of the electrophotographic photoreceptor using a contact charging system (DC contact charging system) that applies only a direct-current voltage to the charging member.

Figure 4:
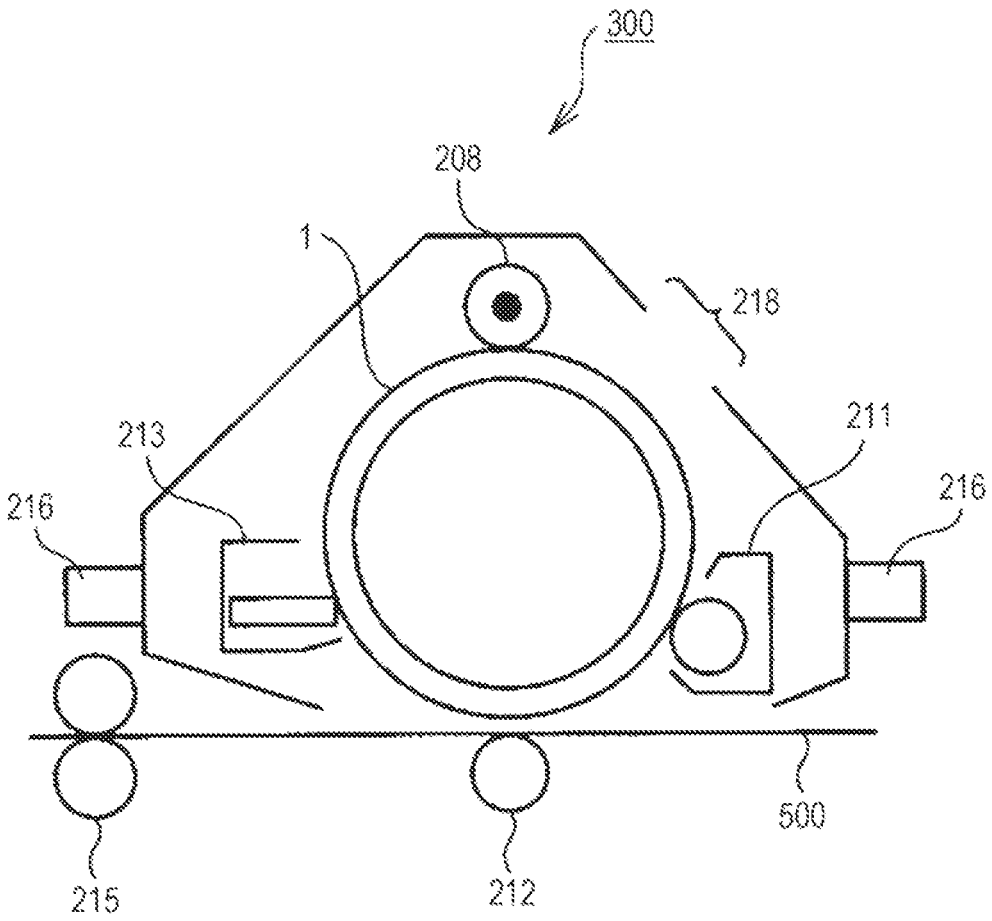
FIG. 4 is a schematic view showing an example of a basic configuration of a process cartridge according to an exemplary embodiment of the present disclosure.

FIG. 4 schematically shows the basic configuration of an example of the process cartridge according to the exemplary embodiment. Besides the electrophotographic photoreceptor 1 and the DC contact charging system charging device which charges the surface of the electrophotographic photoreceptor 1 by applying a direct-current voltage to the charging member, a process cartridge 300 includes a developing device 211 which develops, with a developer containing a toner, an electrostatic latent image formed on the surface of the electrophotographic photoreceptor 1 by exposure to form a toner image, a toner removing device 213 which removes the toner remaining on the surface of the electrophotographic photoreceptor 1 after transfer, and an opening 218 for exposure. These are combined and integrated by using a mounting rail 216.

The process cartridge 300 is detachable from an image forming apparatus including the transfer device 212, which transfers the toner image formed on the surface of the electrophotographic photoreceptor 1 to the recording medium 500, the fixing device 215 which fixes the toner image transferred to the recording medium 500 to the recording medium 500, other components not shown, and constitutes the image forming apparatus together with the body of the image forming apparatus.

Besides the electrophotographic photoreceptor 1, the charging device, the developing device 211, the toner removing device 213, and the opening 218 for exposure, the process cartridge 300 may be provided with an exposure device (not shown) which exposes the surface of the electrophotographic photoreceptor 1.

EXAMPLES

The exemplary embodiment is specifically described by giving examples below, but the exemplary embodiment is not limited to these examples.

[Formation of electrophotographic photoreceptor]

(Photoreceptor 1)

—Formation of Undercoating Layer—

First, 60 parts by mass of zinc oxide particles (manufactured by Tayca Corporation, average particle diameter: 70 nm, specific surface area value: 15 $m^2/g$) and 500 parts by mass of tetrahydrofuran are stirred and mixed, and 1.25 parts by mass of KBM 603 (N-2-(aminoethyl)-3-aminopropyl trimethoxysilane, manufactured by Shin-Etsu Chemical Co., Ltd.) as a silane coupling agent (surface treatment agent) relative to 100 parts by mass of the zinc oxide particles is added and stirred for 2 hours. Then, methanol is removed by reduced-pressure distillation, and the residue is baked at 120° C. for 3 hours to obtain zinc oxide particles surface-treated with the silane coupling agent.

Then, 100 parts by mass of the zinc oxide particles surface-treated with the silane coupling agent, 1 part by mass of anthraquinone as an electron accepting compound, 22.5 parts by mass of blocked isocyanate (Sumijule 3173, manufactured by Sumitomo Bayer Urethane Co., Ltd.) as a curing agent, and 25 parts by mass of butyral resin (S-lec BM-1, manufactured by Sekisui Chemical Co., Ltd.) are dissolved in 142 parts by mass of methyl ethyl ketone. Next, 38 parts by mass of the resultant solution and 25 parts by mass of methyl ethyl ketone are mixed and dispersed for 4 hours by a sand mill using glass beads having a diameter of 1 mm, preparing a dispersion liquid. To the resultant dispersion liquid, 0.008 parts by mass of dioctyl tin dilaurate as a catalyst and 6.5 parts by mass of silicone resin particles (Tospearl 145, manufactured by GE Toshiba Silicones Co., Ltd.) are added, thereby obtaining a coating solution for forming an undercoating layer.

The resultant coating solution is coated on an aluminum substrate having a diameter of 30 mm by a dip coating method and dried and cured at 170° C. for 24 minutes, forming an undercoating layer having a thickness of 26 μm.

—Formation of charge generation layer—

Next, a mixture of 15 parts by mass of chlorogallium phthalocyanine crystal as a charge generation material, having a strong diffraction peak at the Bragg angles (2θ±) 0.2° of at least 7.4° , 16.6° , 25.5° , and 28.3° for CuKa characteristic X-ray, 10 parts by mass of vinyl chloride-vinyl acetate copolymer resin (VMCH, manufactured by Nippon Union Carbide Corporation), and 300 parts by mass of n-butyl alcohol is dispersed for 4 hours by a sand mill using glass beads having a diameter of 1 mm, preparing a coating solution for forming a charge generation layer.

The resultant coating solution for forming an electron generation layer is dip-coated on the undercoating layer and dried to form a charge generation layer having a thickness of 0.2μm.

—Formation of Charge Transport Layer—

Next, 8 parts by mass of tetrafluoroethylene resin particles (average particle diameter: 0.2 μm), 0.015 parts by mass of fluoroalkyl group-containing methacrylic copolymer (weight-average molecular weight: 30000), 4 parts by mass of tetrahydrofuran, and 1 part by mass of toluene are stirred and mixed for 48 hours while a liquid temperature of 20° C. is maintained, preparing a tetrafluoroethylene resin particle suspension A.

Next, 4 parts by mass of N,N'-diphenyl-N,N'-bis(3-methylphenyl)-[1,1']biphenyl-4,4'-diamine as a charge transport material, 6 parts by mass of bisphenol Z-type polycarbonate resin (viscosity-average molecular weight: 40,000), and 0.1 parts by mass of 2,6-di-tert-butyl-4-methylphenol as an antioxidant are mixed, and 24 parts by mass of tetrahydrofuran and 11 parts by mass of toluene are mixed and dissolve the components, preparing a mixed solution B.

In the resultant mixed solution B, the tetrafluoroethylene resin particle suspension A is added and stirred and mixed, and then dispersion treatment under the pressure increased to 500 $kgf/cm^2$ is repeated 6 times by using a high-pressure homogenizer (manufactured by Yoshida Kikai Co., Ltd.) provided with a penetration-type chamber having a fine flow passage. Then, fluorine-modified silicone oil (trade name, FL-100 manufactured by Shin-Etsu Chemical Co., Ltd.) is added so as to become 5 ppm and stirred to prepare a coating solution for forming a charge transport layer.

The resultant coating solution is coated on the charge generation layer and dried at 140° C. for 25 minutes to form a charge transport layer having a thickness of 22.0 μm, producing an intended electrophotographic photoreceptor. The resultant electrophotographic photoreceptor is referred to as "photoreceptor A".

[Formation of Charging Member]

<EXAMPLE 1>

—Formation of elastic layer—

Epichlorohydrin rubber (Gechron 3106, manufactured by Zeon Corporation): 100 parts by mass Carbon black (Asahi #60, manufactured by Asahi Carbon Co., Ltd.): 6 parts by mass Calcium carbonate (Whiton SB, manufactured by Shiraishi Calcium Kaisha, Ltd.): 20 parts by mass Ionic conductive agent (BTEAC, manufactured by Lion Corporation): 5 parts by mass Vulcanization accelerator: stearic acid (manufactured by NOF Corporation): 1 part by mass Vulcanizing agent: sulfur (Vulnoc R, manufactured by Ouchi Shinko Chemical Industrial Co., Ltd.): 1 part by mass Vulcanization accelerator: zinc oxide: 1.5 parts by mass A mixture of the composition described above is kneaded by an open roll, and a roll-shape elastic layer having a diameter of 15 mm is formed by using a press molding machine on the surface of a metal shaft (conductive substrate) made of SUS 303 and having a diameter of 8 mm through an adhesive. Then, a conductive elastic roll A having a diameter of 14 mm is obtained after polishing. Binder resin: N-methoxymethylated nylon (trade name F30K, manufactured by Nagase Chemtex Corporation): 100 parts by mass Resin: polyvinyl butyral (trade name S-Lec BL-1, manufactured by Sekisui Chemical Co., Ltd.): 25 parts by mass Particle A: carbon black (trade name: MONAHRCH 1000, manufactured by Cabot Corporation): 15 parts by mass Particle B: polyamide particle (Polyamide 12, manufactured by Arkema Inc.): 10 parts by mass Additive: dimethylpolysiloxane (BYK-307, manufactured by Altana Inc.): 1 part by mass A mixture of the composition described above is diluted with methanol/1-propanol and dispersed by a beads mill, preparing a dispersion liquid. The resultant dispersion liquid is dip-coated on the surface of the conductive elastic roll A and dried by heating at 130° C. for 30 minutes, forming a surface layer having a thickness of 10 μm. As described above, a charging member (charging roller) 1 of Example 1 is obtained.

<EXAMPLES 2 TO 8 AND COMPRATIVE EXAMPLES 1 TO 4>

A charging member of each of the examples and comparative examples is produced by the same method as in Example 1 except that in forming the surface layer, the solvent composition, the solid content amount of the mixture, the composition ratio of the binder resin, the amount of carbon black added, and the amount of polyamide particles added are changed to those shown in Table 1.

<EXAMPLE 9>

A charging member of Example 9 is produced by the same method as in Example 1 except that in forming the surface layer, carbon black (trade name: MONAHRCH 1500, manufactured by Cabot Corporation) is used as the particle A in place of carbon black (trade name: MONAHRCH 1000, manufactured by Cabot Corporation).

<Measurement of impedance Z and resistance component R of impedance by alternating-current impedance method>

The impedance Z and the resistance component R of the impedance are measured by using SI 1260 impedance/gain phase analyzer (manufactured by Toyo Corporation) as a power source and an ammeter, and 1296 dielectric interface (manufactured by Toyo Corporation) as a current amplifier.

In a sample (charging member) for measuring the impedance, a conductive substrate is used as a cathode, and an aluminum plate having a width of 1.5 cm wound one turn around the surface of the charging member is used as an anode. The impedance Z and the resistance component R of the impedance of the sample are measured by an alternating current impedance method in which an alternating-current voltage of 1 Vp-p is applied within a frequency range of 1 MHz to 1 mHz from the high-frequency side thereof.

<Measurement of surface roughness Rz>

The surface roughness Rz is measured in an environment at a temperature of 23° C. and relative humidity of 55% by using a contact-type surface roughness tester (Surfcom 570A, manufactured by Tokyo Seimitsu Co., Ltd.) and a stylus having a diamond tip (5 μm R, 90° cone). The measurement distance is 2.5 mm, and a measurement part ranges from a position of 5 mm to a position of 7.5 mm from an end of a discharge region. In the roll-shape charging member, the measurement is performed at 4 positions at intervals of 90 degrees in the circumferential direction of the charging member at both ends of the discharge region, and an average of the vales at a total of 8 positions is calculated.

<Evaluation of color streak occurrence-suppressing property>

The photoreceptor A produced as described above and the charging member produced in each of the examples and comparative examples are incorporated into a modified machine of DocuCentre 505a (manufactured by Fujifilm Business Innovation Corp.) including, as a charging unit, a contact charging unit which applies only a direct-current voltage, and an A4 halftone image is output with an image density of 30% under the conditions of high temperature-high humidity. The number of color streaks occurring in a region of 94 mm in length and 200 mm in width from the upper left side of the print sample is evaluated according to criteria below. The high temperature and high humidity represent a surrounding environment of 28° C. and 85 RH (relativity humidity). The evaluation results are shown in Table 1.

G0: No occurrence

G1: Occurrence of color streaks at 1 or more and 3 or less positions

G2: Occurrence of color streaks at 4 or more and 10 or less positions

G3: Occurrence of color streaks at 11 or more and 20 or less positions

G4: Occurrence of color streaks at 21 or more positions

<Evaluation of lifetime>

The photoreceptor A produced as described above and the charging member produced in each of the examples and comparative examples are incorporated into a modified machine of DocuCentre 505a (manufactured by Fujifilm Business Innovation Corp.) including, as a charging unit, a contact charging unit which applies only a direct-current voltage, and an A4 halftone image is output on 200,000 sheets with an image density of 30% under the conditions of high temperature-high humidity.

Then, the thickness of the photosensitive layer before mounting and the thickness of the photosensitive layer after mounting are measured by an eddy-current type thickness gauge, and a difference is calculated as an abrasion amount and evaluated according to criteria below. The evaluation results are shown in Table 1.

A: less than 1.0 μm

B: 1.0 μm or more and less than 1.2 μm

C: 1.2 μm or more

| | Composition ratio by mass of solvent in mixture for forming surface layer | Solid content ratio of mixture for forming surface layer (% by mass) | Composition ratio by mass of N-methoxymethylated nylon/polyvinylbutyral | Amount of carbon black added (Parts by mass) | Amount of polyamide particles added (Parts by mass) | Resistance component R of impedance at 1 Hz to 100 Hz (Ω) |
|---|---|---|---|---|---|---|
| Example 1 | Methanol/1-propanol = 7/3 | 18 | 8/2 | 15 | 10 | $6.5 \times 10^5$ |
| Example 2 | Methanol/1-propanol = 9/1 | 18 | 8/2 | 15 | 10 | $3.7 \times 10^5$ |
| Example 3 | Methanol/1-propanol = 7/3 | 20 | 8/2 | 15 | 10 | $8.0 \times 10^4$ |
| Example 4 | Methanol/1-propanol = 7/3 | 18 | 7/3 | 15 | 10 | $1.0 \times 10^6$ |
| Example 5 | Methanol/1-propanol = 7/3 | 18 | 8.5/1.5 | 15 | 7 | $3.4 \times 10^5$ |
| Example 6 | Methanol/1-propanol = 7/3 | 18 | 8/2 | 15 | 7 | $2.65 \times 10^5$ |
| Example 7 | Methanol/1-propanol = 7/3 | 18 | 8.5/1.5 | 15 | 7 | $1.0 \times 10^6$ |

-continued

| | | | | | | |
|---|---|---|---|---|---|---|
| Example 8 | Methanol/1-propanol = 7/3 | 18 | 7/3 | 15 | 7 | $4.6 \times 10^5$ |
| Example 9 | Methanol/1-propanol = 7/3 | 18 | 8/2 | 15 | 10 | $2.6 \times 10^5$ |
| Comparative Example 1 | Methanol/1-propanol = 7/3 | 18 | 8/2 | 10 | 10 | $8.4 \times 10^5$ |
| Comparative Example 2 | Methanol/1-propanol = 7/3 | 18 | 8/2 | 20 | 10 | $6.4 \times 10^5$ |
| Comparative Example 3 | Methanol/1-propanol = 7/3 | 15 | 8/2 | 15 | 10 | $1.3 \times 10^6$ |
| Comparative Example 4 | Methanol/1-propanol = 7/3 | 18 | 9/1 | 15 | 10 | $1.1 \times 10^6$ |

| Example 1 | Impedance Z at 1 Hz to 100 Hz (Ω) | Surface roughness Rz (μm) | Process speed (mm/sec) | Evaluation of color streak occurrence-suppressing property | Evaluation of lifetime |
|---|---|---|---|---|---|
| Example 2 | $5.51 \times 10^4$-$1.24 \times 10^5$ | 4.8 | 60 | G1 | B |
| Example 3 | $4.23 \times 10^4$-$2.21 \times 10^5$ | 5.0 | 60 | G1 | A |
| Example 4 | $3.64 \times 10^4$-$2.50 \times 10^5$ | 4.0 | 60 | G0 | A |
| Example 5 | $5.67 \times 10^4$-$3.50 \times 10^5$ | 6.0 | 60 | G1 | B |
| Example 6 | $5.34 \times 10^4$-$1.97 \times 10^5$ | 3.0 | 60 | G0 | A |
| Example 7 | $4.36 \times 10^4$-$1.23 \times 10^5$ | 4.7 | 60 | G1 | A |
| Example 8 | $5.18 \times 10^4$-$2.04 \times 10^5$ | 2.6 | 60 | G1 | A |
| Example 9 | $9.81 \times 10^4$-$3.03 \times 10^5$ | 5.8 | 60 | G1 | A |
| Comparative | $8.93 \times 10^4$-$2.37 \times 10^5$ | 4.3 | 60 | G1 | A |
| Example 1 | $7.28 \times 10^4$-$5.30 \times 10^5$ | 4.5 | 60 | G2 | C |
| Comparative Example 2 | $7.15 \times 10^4$-$3.51 \times 10^5$ | 4.5 | 60 | G2 | C |
| Comparative Example 3 | $5.45 \times 10^4$-$4.49 \times 10^5$ | 4.9 | 60 | G2 | C |
| Comparative Example 4 | $4.37 \times 10^4$-$1.97 \times 10^5$ | 4.0 | 60 | G3 | C |

It can be confirmed from the evaluation results that the occurrence of color streaks is suppressed by the charging members of the examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A charging member of a contact charging system that applies only a direct-current voltage to the charging member, the charging member comprising:

a conductive substrate;

an elastic layer disposed on the conductive substrate; and a surface layer disposed on the elastic layer, wherein when the charging member is measured by an alternating-current impedance method within a range of 1 MHz to 1 mHz in an environment at a temperature of 28° C. and a humidity of 85%, a resistance component R of an impedance within a range of 1 Hz to 100 Hz is $4.0\times10^4$ Ω or more and $1.0\times10^6$ Ω or less and an impedance Z within a range of 1 Hz to 100 Hz is over $3.6\times10^4$ Ω and $3.5\times10^5$ Ω or less.

2. The charging member according to claim 1, wherein a surface roughness Rz is 3 μm or more and 5 μm or less.

3. The charging member according to claim 2, wherein a surface roughness Rz is 3.5 μm or more and 4.5 μm or less.

4. The charging member according to claim 1, wherein the resistance component R is $5.0\times10^4$ Ω or more and $7.5\times10^5$ Ω or less.

5. The charging member according to claim 4, wherein the resistance component R is $5.0\times10^4$ Ω or more and $2.0\times10^5$ Ω or less.

6. The charging member according to claim 1, wherein the impedance Z is over $3.6\times10^4$ Ω and $3.0\times10^5$ Ω or less.

7. The charging member according to claim 6, wherein the impedance Z is over $3.6\times10^4$ Ω and $2.7\times10^5$ Ω or less.

8. The charging member according to claim 1, wherein the surface layer contains a polyvinyl butyral resin.

9. The charging member according to claim 8, wherein the surface layer further contains a polyamide resin.

10. The charging member according to claim 9, wherein the surface layer has a sea-island structure having a sea structure made of the polyamide resin, and an island structure made of the polyvinyl butyral resin.

11. A charging device comprising the charging member according to claim 1.

12. An image forming apparatus comprising:

an electrophotographic photoreceptor;

a charging unit that has the charging member according to claim 1 and charges a surface of the electrophotographic photoreceptor by a contact charging system that applies only a direct-current voltage to the charging member;

an electrostatic latent image forming unit that forms an electrostatic latent image on the charged surface of the electrophotographic photoreceptor;

a developing unit that develops the electrostatic latent image formed on the surface of the electrophotographic photoreceptor with a developer containing a toner to form a toner image; and a transfer unit that transfers the toner image to a surface of a recording medium.

13. A process cartridge comprising a charging unit that has the charging member according to claim 1 and charges a surface of an electrophotographic photoreceptor by a contact charging system that applies only a direct-current voltage to the charging member, wherein the process cartridge is detachable from an image forming apparatus.

* * * * *